US009505533B2

(12) United States Patent
Aneas

(10) Patent No.: US 9,505,533 B2
(45) Date of Patent: Nov. 29, 2016

(54) STOPPING DEVICE AND CONTAINER COMPRISING SUCH A DEVICE

(75) Inventor: Antoine Aneas, Menetrol (FR)

(73) Assignee: Biocorp Recherche et Developpement, Saint Beauzire (FR)

( * ) Notice: Subject to any disclaimer, the term of this patent is extended or adjusted under 35 U.S.C. 154(b) by 117 days.

(21) Appl. No.: 14/123,908

(22) PCT Filed: Jun. 7, 2012

(86) PCT No.: PCT/EP2012/060788

§ 371 (c)(1),
(2), (4) Date: Feb. 23, 2014

(87) PCT Pub. No.: WO2012/168353

PCT Pub. Date: Dec. 13, 2012

(65) Prior Publication Data

US 2014/0209603 A1 Jul. 31, 2014

(30) Foreign Application Priority Data

Jun. 8, 2011 (FR) ..... 11 55015

(51) Int. Cl.
*B65D 25/08* (2006.01)
*B65D 51/00* (2006.01)
(Continued)

(52) U.S. Cl.
CPC ..... *B65D 51/20* (2013.01); *A61J 1/18* (2013.01); *B65D 51/002* (2013.01); *B65D 51/18* (2013.01);
(Continued)

(58) Field of Classification Search
CPC B65D 25/082; B65D 51/002; B65D 51/241; B65D 41/58; B65D 41/60; A61J 1/2041
USPC ..... 215/249, 213, 251, 253, 358, 295, 301, 215/320, 342
See application file for complete search history.

(56) References Cited

U.S. PATENT DOCUMENTS 2,054,032 A * 9/1936 Conner ..... B65D 55/022 215/252
2,560,793 A * 7/1951 Greene ..... B65D 55/022 215/252

(Continued)

FOREIGN PATENT DOCUMENTS

CA 2 341 423 A1 3/2000
CN 1315916 A 10/2001

(Continued)

OTHER PUBLICATIONS

Search Report for Patent Application No. PCT/EP2012/060788.

(Continued)

*Primary Examiner* — Fenn Mathew
*Assistant Examiner* — Andrew T Kirsch
(74) *Attorney, Agent, or Firm* — Soquel Group LLC

(57) ABSTRACT

A stopping device, comprising a stopper and a plastic cap to cover a container's neck with the stopper in the neck, the cap comprising a cover and a ring surrounding the stopper and the neck when mounted onto the neck, the ring and cover being produced as a single component connected by at least one part breakable by a force parallel to a central axis of the ring directed towards the stopper, the cover having an element resting against the stopper, the breakable part having bridges extending between an outer radial edge of the cover and an inner radial edge of the ring, and a channel in an arc of a circle defined between two adjacent bridges, the length of the cover's outer radial edge and the length of the rings inner radial edge, the channel having radial width smaller than 0.3 mm and axial height more than 0.15 mm.

17 Claims, 8 Drawing Sheets

(51) Int. Cl.

| | |
|---|---|
| ***B65D 51/24*** | (2006.01) |
| ***A61J 1/20*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/20*** | (2006.01) |
| ***A61J 1/18*** | (2006.01) |
| ***B65D 51/18*** | (2006.01) |
| *A61J 1/14* | (2006.01) |

(52) U.S. Cl.
CPC ..... *B65D 51/241* (2013.01); *A61J 1/1406* (2013.01); *B65D 2251/0009* (2013.01); *B65D 2251/009* (2013.01)

(56) References Cited

U.S. PATENT DOCUMENTS

| | | | | |
|---|---|---|---|---|
| 3,087,638 | A * | 4/1963 | Loper | 206/221 |
| 4,089,432 | A * | 5/1978 | Crankshaw et al. | 215/6 |
| 4,652,429 | A * | 3/1987 | Konrad | 422/550 |
| 5,125,921 | A * | 6/1992 | Duschek | 604/415 |
| 5,464,111 | A * | 11/1995 | Vacek et al. | 215/249 |
| 2010/0224632 | A1 | 9/2010 | Aneas | |
| 2011/0000872 | A1 | 1/2011 | Aneas | |

FOREIGN PATENT DOCUMENTS

| | | | |
|---|---|---|---|
| CN | 2702935 | Y | 6/2005 |
| CN | 1826265 | A | 8/2006 |
| CN | 101316769 | A | 12/2008 |
| CN | 101952179 | A | 1/2011 |
| DE | 40 29 832 | A1 | 3/1992 |
| DE | 195 32 980 | A1 | 3/1997 |
| EP | 0 348 762 | A1 | 1/1990 |
| WO | 2004096113 | A2 | 11/2004 |

OTHER PUBLICATIONS

English translation of Publication CN 2702935 Y, Jun. 1, 2005.

* cited by examiner

STOPPING DEVICE AND CONTAINER COMPRISING SUCH A DEVICE

CROSS-REFERENCES TO RELATED APPLICATIONS

This application claims priority benefit under 35 U.S.C. §371 to International Patent Application No. PCT/EP2012/060788 entitled STOPPING DEVICE AND CONTAINER COMPRISING SUCH A DEVICE, and filed by inventor Antoine Aneas on Jun. 7, 2012. International Patent Application No. PCT/EP2012/060788 claims priority to French Patent Application No. 11 55015, filed by inventor Antoine Aneas on Jun. 8, 2011.

FIELD OF THE INVENTION

The invention relates to a stopping device for a container, said device comprising a stopper provided to close the neck of the container, as well as a cap. The invention also relates to a container, for example a medicine bottle, equipped with such a stopping device.

BACKGROUND OF THE INVENTION

In the field of medicine containers, it is known to use a glass bottle to store an active ingredient in freeze-dried, powdered or liquid solution form. Such a bottle must be closed sealably so as to keep its contents under satisfactory storage conditions, until its use-by date. To hermetically seal such a bottle, it is known to use a stopping device that comprises a cylindrical stopper made from elastomer provided to close the neck of the bottle. The purpose of the stopper is to ensure the most complete sealing possible against gases, liquids and bacteria. It is known to combine such a stopper with a metal capsule with a membrane. The container is opened by tearing the metal capsule by pulling on the membrane. This may be problematic inasmuch as the metal capsule, which is most often made from aluminum, may break, which requires that it be removed by hand, resulting in a risk of cutting and, most often, the use of the small disassembly tool.

It is known from WO-A 94/04424 to use a plastic capsule that is intended to be immobilized around the stopper to isolate it from the outside. The multi-part structure of this known device makes it expensive. Furthermore, the capsule limits access to the stopper, which cannot be removed, unless the capsule is destroyed, which is not the normal operation of the device.

It is known from WO-A-2008/129144 to use a cover secured to a key for maneuvering a ring intended to be locked on the neck of a glass bottle. This cover is removed by lateral tearing when one wishes to access the contents of the bottle. This maneuver may be delicate for an inexperienced user or an elderly person.

Furthermore, DE-A-195 32 980 teaches forming a continuous rupture line between a cover and a ring belonging to the cap of a stopping device. This continuous line may be difficult for an inexperienced user or an elderly person.

SUMMARY

The invention more particularly aims to resolve these drawbacks by proposing a new stopping device that is particularly simple and intuitive to use and that allows, inter alia, quick and easy removal of the cover for easy access to the contents of a container.

To that end, the invention relates to a stopping device for a container provided with a neck, said device comprising a stopper and a plastic cap able to cover both the neck and the stopper placed in that neck, the cap comprising a ring, capable of surrounding the stopper and the neck in the mounted configuration and being provided with means for locking on the neck, as well as with a cover. The ring and the cover are made as a single component and connected by at least one part that is breakable using a force parallel to a central axis of the ring and oriented toward the stopper, while the cover is equipped with an element bearing against the stopper. This stopping device is characterized in that the breakable part is formed by bridges that extend radially between an outer radial edge of the cover and an inner radial edge of the ring, in that an arc-of-circle-shaped lumen is defined between two adjacent bridges, along the outer radial edge of the cover and the inner radial edge of the ring, and in that said lumen has a radial width smaller than 0.3 mm and an axial height greater than 0.15 mm.

Owing to the invention, the stopper is particularly easy to remove, since it suffices to exert a force thereon oriented toward the stopper, i.e., in practice toward the bottom of a bottle equipped with the stopping device, to break the bridges of the breakable zone. Furthermore, since the cover rests against the stopper owing to its bearing element, the cover undergoes an elastic deformation force by the stopper, which makes it possible to eject the cover from the ring of the cap easily once the breakable part is broken, thereby freeing access to the stopper. The invention uses an atypical approach in the field of medicament packaging, where users are accustomed to covers that can be removed by a lateral force (called "flip off" covers), a pulling force (called "tear off" covers) or a rotational force (in the case of a screw cap). On the contrary, the removal of the inventive stopper requires only a thrust force toward the bottom of the cover, which is particularly simple to do. Furthermore, the dimensions of the lumen defined between two adjacent bridges prevent any fraudulent manipulation of the contents of the container before the cover is removed. In fact, these dimensions are incompatible with the insertion of a needle from the outside of the stopping device into the neck of the container. Lastly, connecting the cover to the ring by bridges makes it possible to calibrate the axial force necessary to break them, with a value lower than that needed to break a continuous line, which makes the cover easier to remove.

According to advantageous but optional aspects of the invention, such a stopping device may incorporate one or more of the following features, considered in any technically allowable combination:

- Each bridge has a favored break zone that is closer to the attachment zone of the bridge on the ring than the attachment zone of the bridge on the cover.
- The locking means comprise teeth each defining a locking surface perpendicular to a central axis and the ring and intended to bear against a surface of a collar outside the neck.
- An annular part of the ring, which covers an upper surface of the stopper in the configuration where the stopping device is mounted on the container, is pierced with passage openings for pins to strip the locking surfaces from the teeth.
- The transverse section of a passage opening of a stripping pin has an area larger than the area of the locking surface situated across from that opening, in a direction parallel to the central axis of the ring.

Each tooth defines a surface sliding against the collar, that surface being in the form of a tapered cone portion and diverging opposite the cover relative to the central axis of the ring.

The bridges have an axial thickness, measured parallel to the central axis of the cover, comprised between 0.1 mm and 0.3 mm, preferably between 0.2 mm and 0.25 mm.

The cover extends, along the central axis of the ring, protruding relative to one edge of the ring opposite the locking means. Preferably, the cover extends, relative to the aforementioned edge of the ring, over an axial height greater than or equal to two times the axial thickness of the bridges, preferably greater than or equal to three times that thickness, still more preferably equal to four times that thickness.

The bearing element of the cover on the stopper is formed by a pin that extends, along the central axis of the cover, toward the stopper, until coming into contact therewith.

In the configuration where the stopping device is mounted on the container, the bearing element of the cover exerts a force on the stopper causing elastic deformation of the central part of the stopper aligned on the neck of the container.

When the bridges break, the stopper exerts an elastic force on the bearing element causing ejection of the stopper, said elastic force resulting from the elastic deformation force of the central part of the stopper previously exerted by the bearing element.

The cover is connected by the breakable part to an annular part of the ring that is perpendicular to a skirt of said ring, intended to surround the neck of the container and equipped with locking means, while the annular part is provided with at least one opening and each opening is bordered, on the side of the stopper, by a rib intended to penetrate the surface of the stopper, radially on the inside of the opening.

The invention also relates to a container, in particular a medicament bottle, that is equipped with a stopping device as described above.

BRIEF DESCRIPTION OF THE DRAWINGS

The invention will be better understood and other advantages thereof will appear more clearly upon reading the following description of one embodiment of a stopping device and a container according to its principle, provided solely as an example and done in reference to the appended drawings, in which.

Table of elements in the figures

Figure 1:
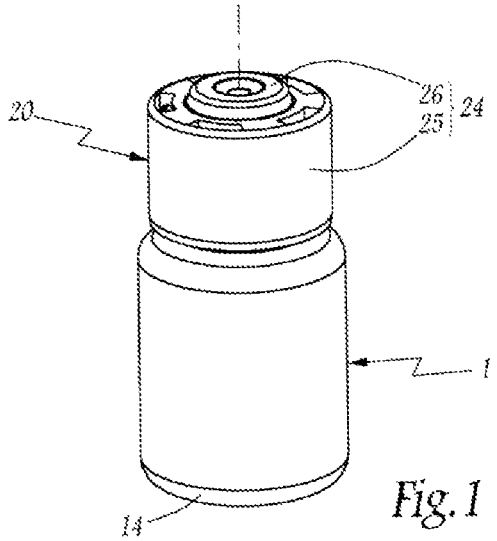
FIG. 1 is a perspective view of a medicine bottle provided with a stopping device according to the invention.

| Element | Description |
|---|---|
| 1 | bottle |
| X1 | axis of symmetry of bottle |
| 11 | bottleneck |
| 12 | neck of bottle |
| 13 | collar of bottle |
| 132 | upper surface of collar |
| 134 | lower surface of collar |
| 14 | bottom of bottle |
| 20 | device (stopper + cap) |
| 21 | stopper |
| X21 | axis of symmetry of stopper |
| 211 | disc-shaped plate |
| 212 | hollow rod |
| 213 | upper surface of stopper |
| 214 | part of stopper |
| 24 | cap (ring + cover) |
| 25 | ring |
| X25 | central axis of ring |
| 251A | outer peripheral skirt of ring: inner surface |
| 251B | outer peripheral skirt of ring: outer surface |
| H251 | axial height of skirt |
| 253A | tooth: locking surface |
| 253B | tooth: sliding surface |
| 254 | annular part of ring |
| 255 | opening |
| 256 | orifice |
| d256 | diameter of orifice |
| 257 | edge of ring |
| 258 | upper annular surface of ring |
| 259 | rib |
| 26 | cover |
| D26 | maximum outer diameter of cover |
| X26 | central axis of cover |
| 261 | outer radial edge of cover |
| 262 | pin |
| 268 | surface of cover opposite pin |
| 27 | bridge |
| e27 | axial thickness of bridge |
| 271 | base of bridge |
| 28 | arc-of-circle-shaped lumen |
| I28 | width of lumen |
| H28 | axial height of lumen |
| 200 | pipette |
| 300A/B/C | needle |
| E1, E1', E2 | force |
| H | protrusion of cover beyond surface of ring |
| S | horizontal planar surface |

DETAILED DESCRIPTION

The bottle 1 shown in the figures is made from glass and comprises a bottleneck 11 defined by a neck 12 having an outer collar 13. X1 denotes the axis of symmetry of the bottle 1, which is also a central axis of the neck 12 and the collar 13. The bottom of the bottle 1 opposite the neck 11 is denoted 14. Reference 132 and 134 denote the surfaces of the collar 13 oriented across from the bottom 14 and toward said bottom, respectively. In other words, the surfaces 132 and 134 respectively make up the upper and lower surfaces of the collar 13 when the bottle 1 rests by its bottom 14 on a horizontal planar surface S, as shown in FIGS. 10 to 13.

Figure 10:
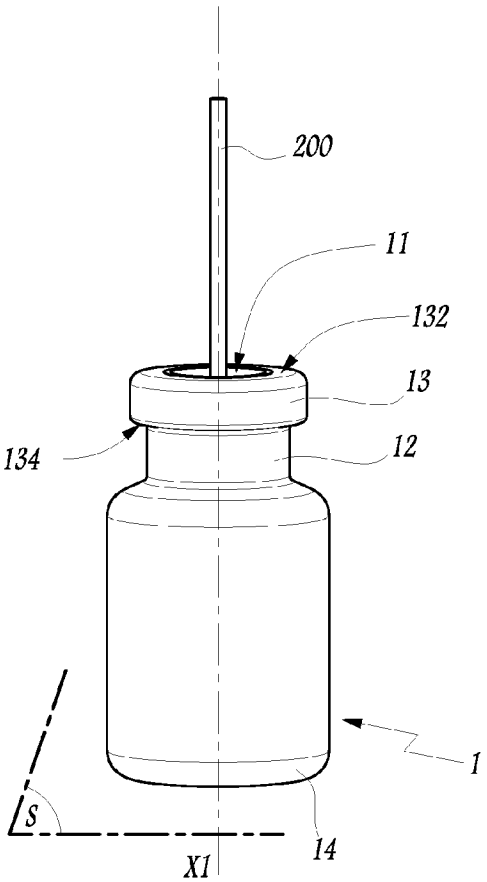

When the bottle 1 is to be filled, a pipette 200 is inserted therein, through its bottleneck 11, as shown in FIG. 10. When a predetermined quantity of product has been inserted into the bottle 1, the pipette 200 is removed and a stopping device 20 is placed on the neck 12. The device 20 comprises an elastomer stopper 21 with a shape suitable for being partially inserted into the bottleneck 11, while resting on the face 132 of the collar 13. The stopper 21 is a single component and comprises a disc-shaped plate 211 intended to rest on the surface 132 as well as a hollow rod 212 intended to penetrate the bottleneck 11. Once placed on the neck 12, the stopper 21 isolates the contents of the bottle 1 from the outside. X21 denotes a central axis of symmetry of the stopper 21. In the configuration where the stopper 21 is assembled on the bottle 1, the axes X1 and X21 are superimposed.

The device 20 also comprises a cap 24 intended to cover and isolate the stopper 21 and the neck 12 from the outside in the closed configuration of the stopping device.

The cap 24 comprises a ring 25 and a cover 26 that are molded together and form a single component as cap 24. In other words, continuous material exists between the elements 25 and 26, within the cap 24.

The ring 25 is provided with five locking teeth 253 below the surface 134 of the collar 13.

Reference 251 denotes an outer peripheral skirt of the ring 25, and X25 denotes a central axis of that ring. This skirt is equipped, on its inner radial surface 251A, with teeth 253 with a triangular section. Each tooth 253 defines a locking surface 253A perpendicular to the axis X25 and intended to bear against the surface 134 when the cap 24 is placed around the neck 12 of the bottle 1. Each tooth 253 also defines a sliding surface 253B that is provided to slide over a junction zone between the surface 132 and the outer radial surface of the collar 13 when the cap 24 is placed on the neck 12.

During that placement, the skirt 251 expands radially, elastically, when the teeth 253 pass by the collar 13, along the axis X1, before the teeth 253 are locked below the collar 13, the surfaces 253A then arriving across from the surface 134 of the collar 13. Thus, the teeth 253 form the locking means of the ring 25 on the neck 12 of the bottle 1. The surfaces 253B are in the shape of a tapered cone portion and diverge downward, which ensures that the elastic radial expansion of the skirt 251 upon passage of the collar 13 is gradual.

Reference 254 denotes the annular part of the ring 25 that partially covers the upper surface 213 of the stopper 21 in the configuration where the device 20 is mounted on the bottle 1, i.e., the surface of the plate 211 opposite the rod 212. The part 254 is perpendicular to the skirt 251 and is pierced with five passage openings 255 for a molding drawer of the surfaces 253A. The surface 213 is accessible through those openings 255.

Each opening 255 has, in transverse section relative to the axis X25, an area sufficient to allow the passage of stripping pins for the locking surfaces 253A of the teeth 253. This area is therefore larger than the area of the surface 253A positioned across from the opening 255, in a direction parallel to the axis X25.

The cover 26 is circular and centered on an axis X26 that is combined with the axis X25 when the elements 25 and 26 of the cap 24 are secured. Reference 261 denotes the outer radial edge of the cover 26, and D26 denotes its maximum outer diameter.

The part 254 is provided with a circular central orifice 256 centered on the axis X25 and whereof the diameter is denoted d256.

The diameter D26 is strictly smaller than the diameter d256 and the edge 261 is positioned, along combined axes X25 and X26, at the height of the edge 257 of the part 254 that defines the orifice 256, radially inside that edge.

During the manufacture of the cap 24 in a single-component piece, the elements 25 and 26 are connected by four bridges 27 that extend, radially relative to the axes X25 and X26, between the edges 261 and 257, and which are in the shape of a trapezoid with their smallest base 271 on the side of the edge 257.

The cover 26 also comprises a pin 262 centered on the axis X26 and turned toward the edge 251B of the skirt 251 situated near the teeth 253. In other words, the pin 262 is turned toward the stopper 21 in the mounted configuration of the device 20.

Reference e27 denotes the axial thickness of the bridges 27, i.e., the thickness measured parallel to the axis X26. This thickness e27 is chosen so that the bridges 27 can be broken under the effect of a force E1 parallel to the axes X25 and X26 and oriented toward the stopper 21, i.e., toward the bottom 14 of a bottle 1 on which the device 20 is mounted. In practice, the value of the thickness e27 is chosen between 0.1 mm and 0.3 mm, preferably between 0.2 mm and 0.25 mm to allow effective immobilization of the cover 26 relative to the ring 25 before breaking of the bridges, and easy breaking under the effect of an axial force, when necessary.

Thus, when the device 20 has been placed on the bottle 1, i.e., when the configuration of FIGS. 1 to 4 and 12 is present, it is possible to exert a force E1 on the stopper 26, which results in a shearing force on the bridges 27, which break at their respective small bases 271.

Figure 2:
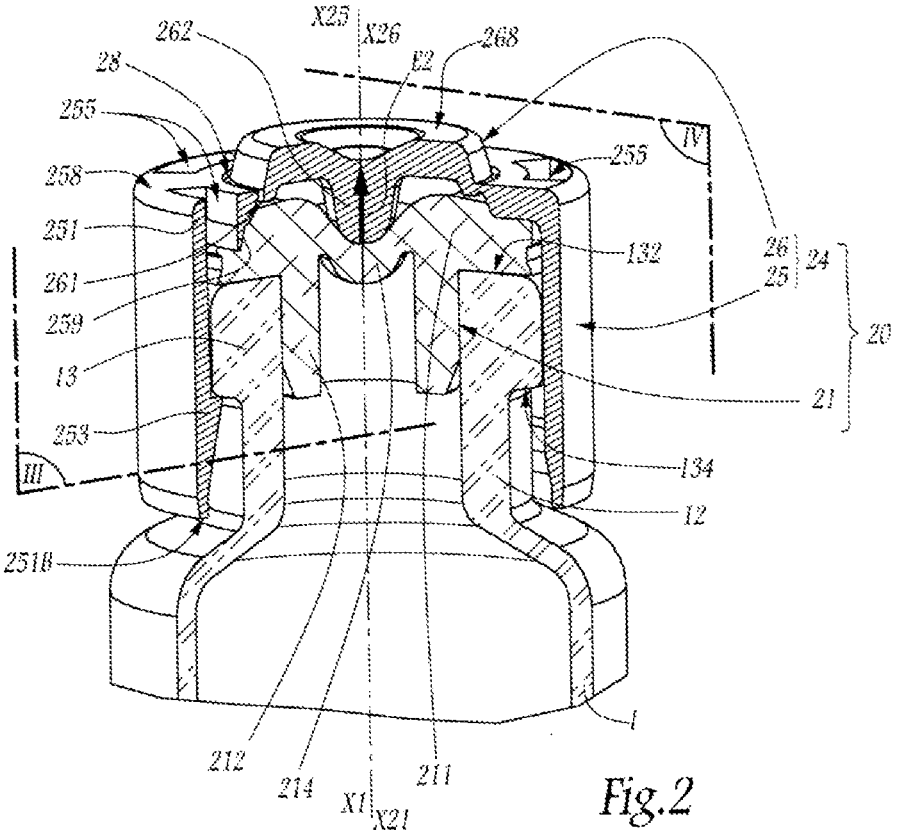
FIG. 2 is a perspective view, with a partial cutaway, of the upper part of the bottle of FIG. 1.
Figure 3:
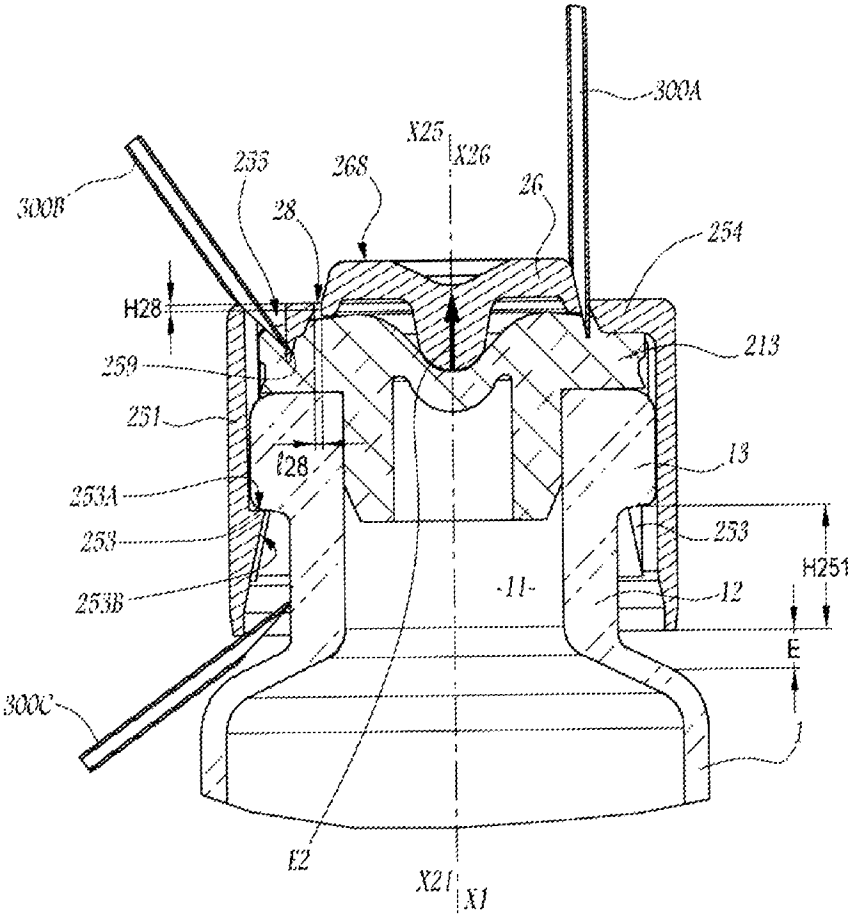
FIG. 3 is a partial cross-sectional view along plane III of FIG. 2 and shows intrusion attempts on the bottle.
Figure 4:
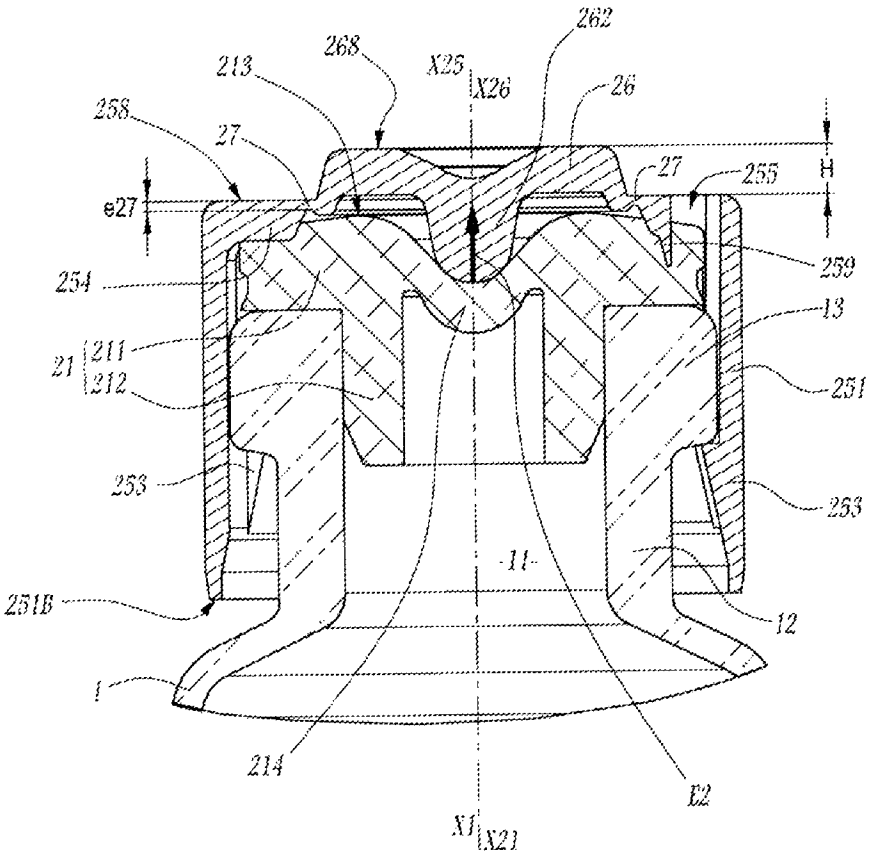
FIG. 4 is a partial cross-sectional view along plane IV of FIG. 2.
Figure 5:
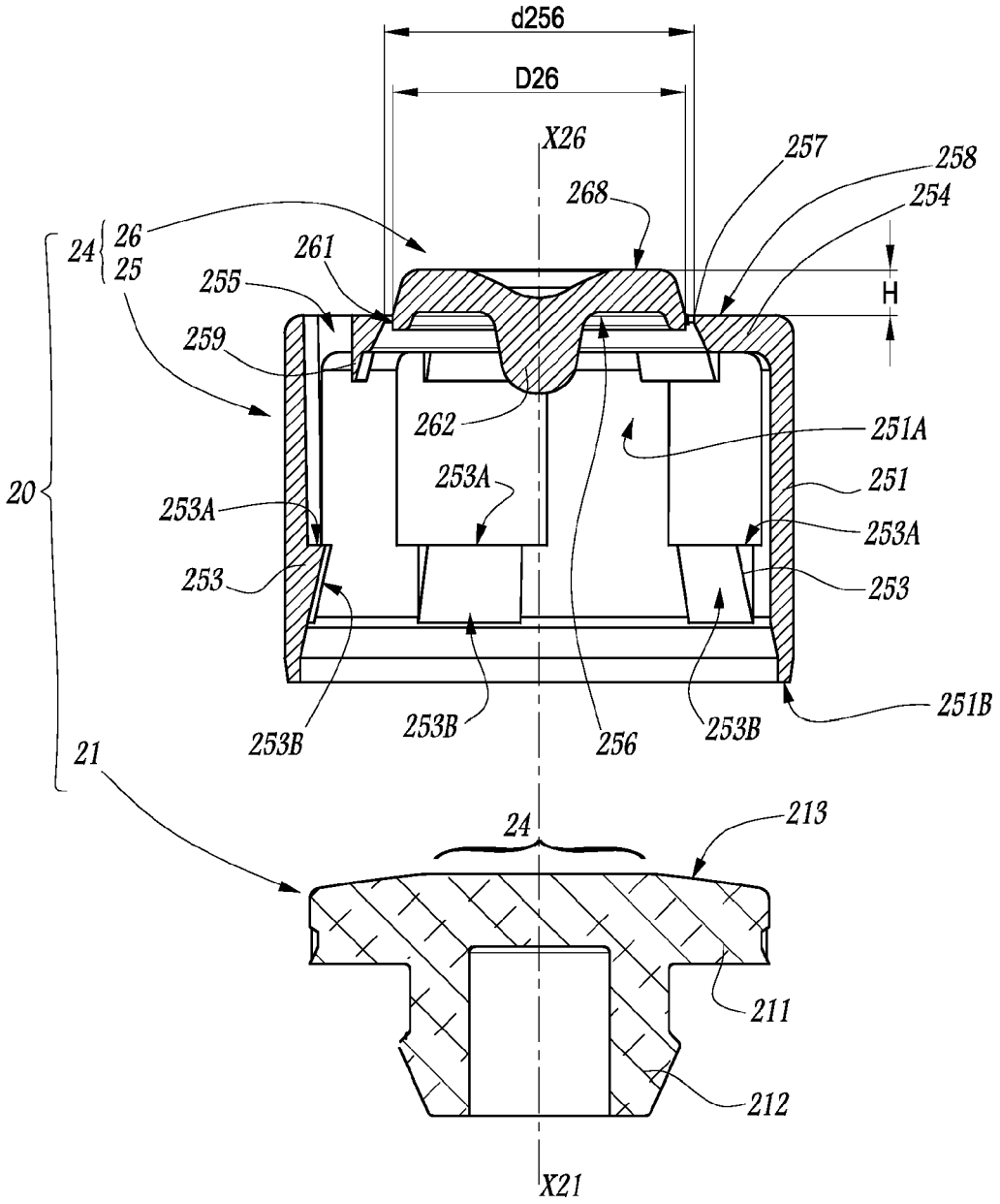
FIG. 5 is an exploded axial cross-sectional view, in the same plane as FIG. 3, of the stopping device alone.
Figure 6:
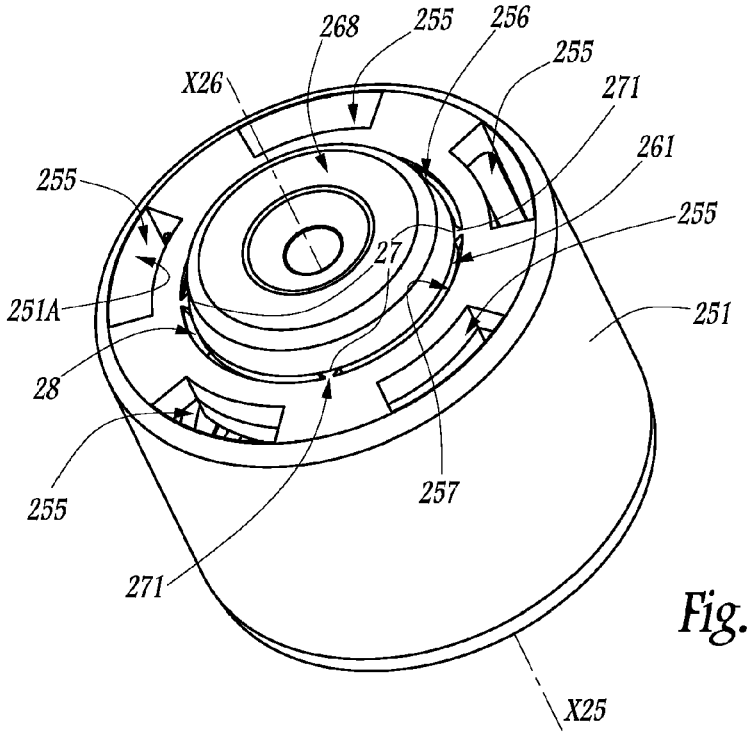
FIG. 6 is a perspective view of the cap of the device of FIG. 5, from a first angle.
Figure 7:
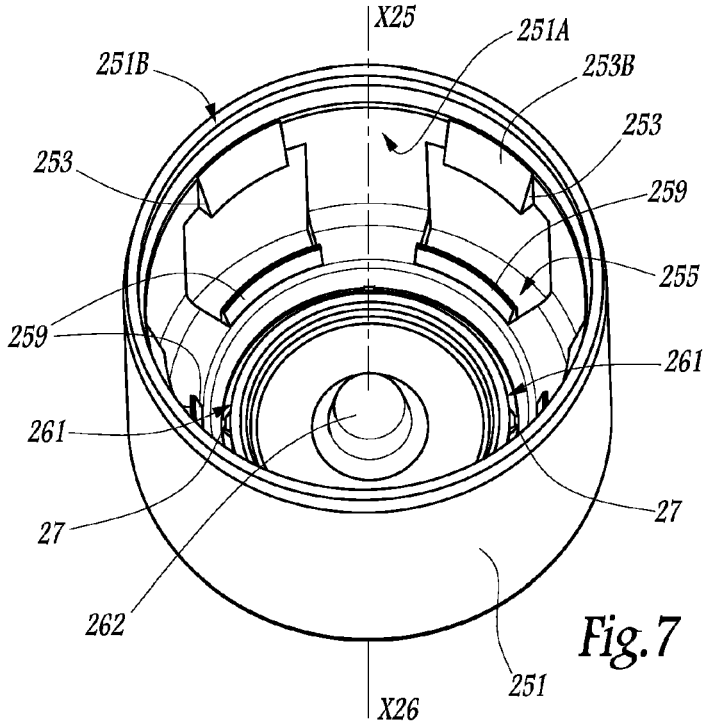
FIG. 7 is a view of the cap of FIG. 6 from another angle.

FIGS. 2 to 4 show that, in the configuration where the device 20 is mounted on the bottle 1, the pin 262 of the cover 26 exerts a force deforming the central part 214 of the plate 211 situated across from the hollow inner volume of the rod 212. This deformation is elastic, such that when the bridges 27 are broken, an elastic force E2 exerted by the stopper 21 on the pin 262 of the cover 26 ejects the latter from the orifice 256. In other words, the user is not required to pull on the cover 26 to separate it from the parts 21 and 24 of the device 20, which remain in place on the bottle 1, since the elastic force E2 performs that function. It will be noted that the force E2 exists before breaking of the bridges 27, since the pin 262 elastically deforms the part 214 when the device 20 is placed on the bottle 1, which uses an approach different from that of DE-A-195 32 980, where, before the breakable zone is broken, the cover does not deform the stopper. By manipulating the dimensions of the pin 262, it is possible to calibrate the elastic deformation of the part 214 before breaking the bridges, and as a result, to calibrate the intensity of the force E2.

Reference 258 denotes the upper annular surface of the part 254. This surface 258 constitutes the edge of the ring 25 that is opposite the locking teeth 253. In the mounted configuration of the device 20, as in particular shown in FIGS. 2 to 4, the cover 26 protrudes beyond the surface 258 relative to the ring 25 over a height H measured parallel to the axis X26 that is at least two times larger than the thickness e27.

Reference 268 further denotes the surface of the cover 26 that is opposite the pin 262. The surface is planar over an annular part, with a central recess corresponding to the base of the pin 262.

In practice, the force E1 is exerted on the cover 26 until the annular part of the surface 268 and the surface 258 is brought to the same axial level, along the axes X25 and X26, which are then superimposed. This causes a sudden and definite break of the bridges 27 inasmuch as this corresponds to an axial movement of the cover 26 over the height H that is at least two times greater than the thickness e27. In fact, the bridges 27 cannot withstand a shearing force causing a movement two times greater than the thickness. In practice, the value 2 of the ratio H/e27 is increased by a safety coefficient, such that that ratio is greater than or equal to three. Particularly satisfactory results may be obtained with a ratio H/e27 equal to four.

Figure 9:
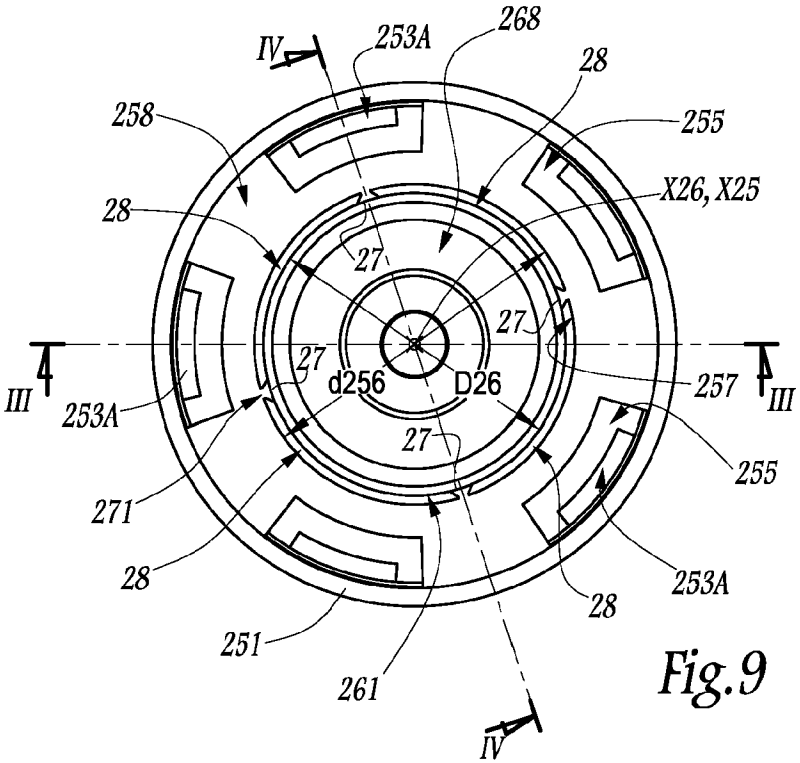
FIG. 9 is a bottom view of the bottle of FIG. 1, on the scale of FIG. 3, where III-III and IV-IV show the cutting planes of FIGS. 3 and 4, FIGS. 10 to 13 show several successive steps of the use of the bottle from the preceding figures.
Figure 8:
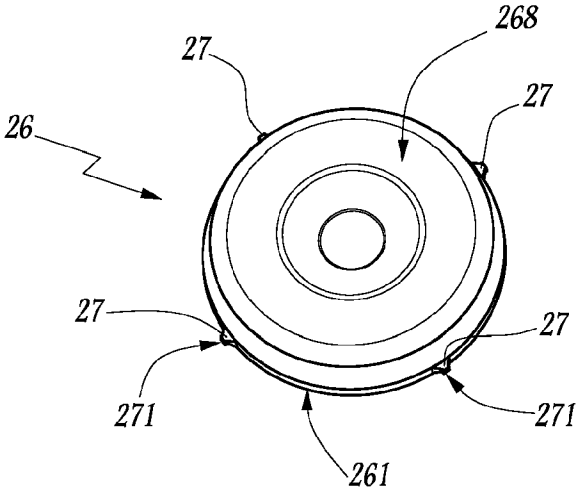
FIG. 8 is a perspective view of the cover, after it has been separated from the ring.
Figure 12:
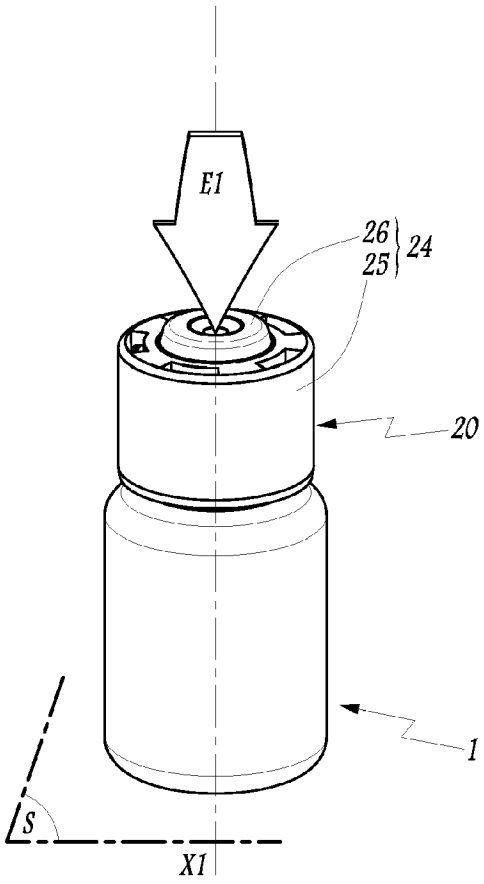

As emerges more particularly from FIG. 9, four arc-of-circle-shaped lumens 28 are defined between the edges 261 and 257, between two adjacent bridges 27. Before removing the cover 26, these lumens constitute the only non-solid part of the orifice 256. Reference l28 denotes the width of these lumens measured, between the edges 261 and 257, radially relative to the axes X25 and X26. H28 denotes the axial height of these lumens measured parallel to the axes X25 and X26.

These dimensions l28 and H28 are chosen so as to prevent the insertion of a slender tool, such as the needle 300A of a hypodermic syringe, into one of the lumens 28, in a position making it possible to access the contents of the bottle 1 without removing the cover 26. To that end, the width en is chosen to be smaller than 0.3 mm, preferably equal to 0.2 mm, while the height H28 is chosen to be greater than 0.15 mm, preferably equal to 0.2 mm. As shown in FIG. 3, a needle 300A can only be inserted in a direction globally parallel to the axes X25 and X26, in which position it abuts against the surface 132 if it has been driven deeply into the plate 211.

To protect the contents of the bottle 1 from a fraudulent manipulation attempt as well, each opening 255 is bordered, radially on the inside and on the side opposite the surface 258, by a rib 259 that superficially penetrates the surface 213. Thus, as shown in the upper left part of FIG. 3, inserting a needle 300B into one of the openings 255 does not make it possible to access the contents of the bottle 1, through the inner stopper 21, whereas the openings each have a transverse section with a relatively large area for the passage of the stripping pins, as explained above. It will be understood that the issue of protecting the contents of the bottle 1 from fraudulent manipulation using the needle 300B is related to the existence and the size of the openings 255, which are necessary to mold the surfaces 253A of the teeth 253, which constitute the means for effective locking on the neck 12, unlike the bead known from DE-A-195 32 980. In other words, the presence and the function of the ribs 259 indirectly results from the use of the teeth 253.

Furthermore, the axial height H251 of the skirt 251, in the part thereof that protrudes below the surface 134, is chosen as a function of the dimensions of the neck 12 such that the annular space E that remains between the edge 251B and the body of the bottle 1 only allows the insertion of a needle 300C in a position where it abuts against the neck 12, without any possibility of acting on the teeth 253. This thereby prevents fraudulent manipulation by preventing a dishonest user from removing the ring 25 from the neck 12.

Thus, once placed on the neck 12, the device 20 guarantees the integrity of the contents of the bottle 1.

Figure 11:
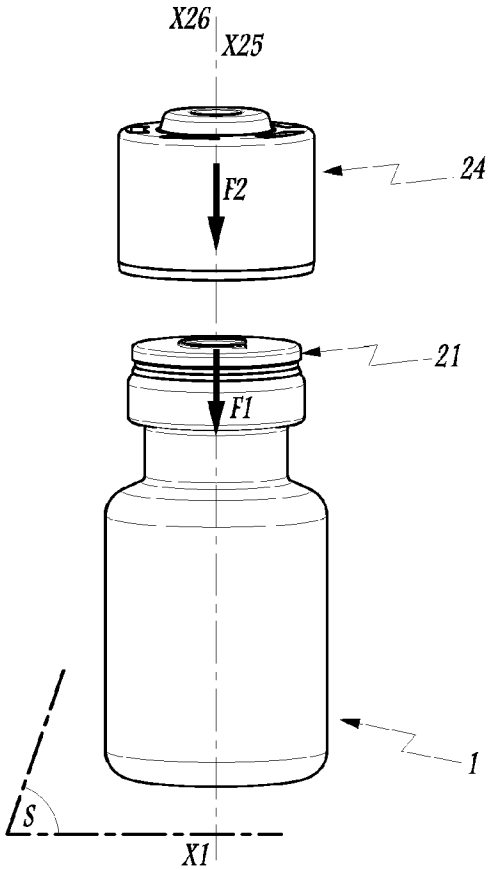
Figure 13:
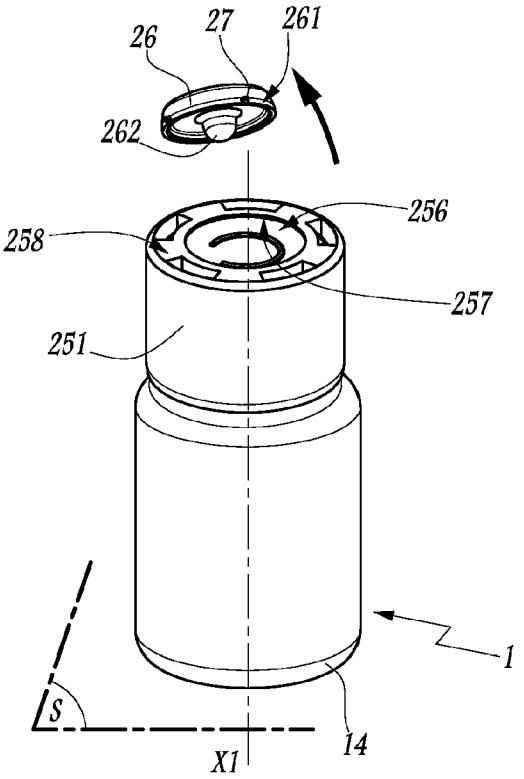

The operation of the device 20 is as follows:

When this device is placed on the bottle 1 and after the stopper 21 and the cap 24 are placed on the bottle 1, as shown by arrows F1 and F2 in FIG. 11, and when a force E1 is exerted parallel to the axes X25 and X26 and bringing the annular part of the surface 268 to the surface 258, the bridges 27 are broken, without having to exert a rotational or pulling force, and the configuration of FIG. 13 is achieved where the cover 26 is separated from the ring 25, allowing access to the upper surface 213 of the stopper 21, through the orifice 256.

The separation of the cover 26 from the bottle 1 occurs owing to the elastic force E2 exerted on the cover by the stopper 21.

After removal of the cover, it is possible to use the needle of a syringe to inject a liquid into the bottle for reconstituting a medicament, then to withdraw the reconstituted medicament.

Figure 14:
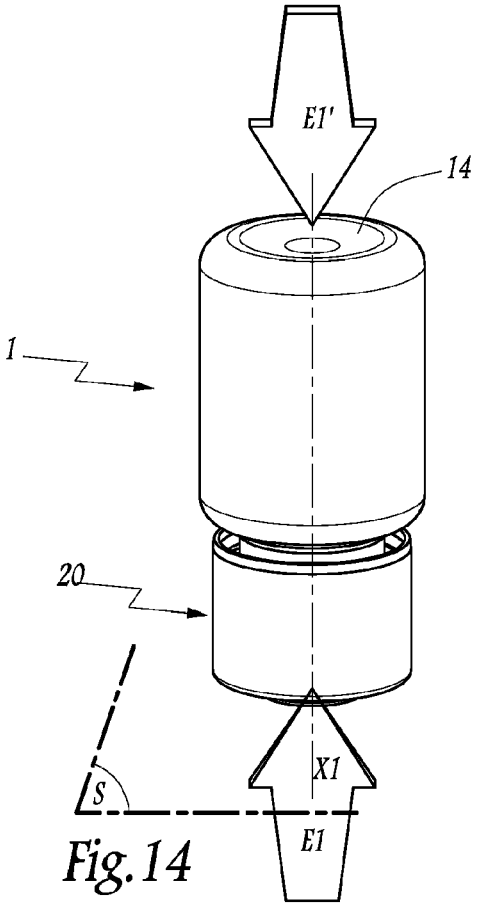
FIG. 14 is an illustration comparable to FIG. 12 that corresponds to another manner of using the bottle.

Alternatively, and as shown in FIG. 14, it is possible to place the bottle 1 equipped with the device 20 upside down on the planar surface 2 and to exert a force E1' oriented toward the surface Son the bottom 14 of the bottle 1. This also results in moving the cover 26 toward the stopper 1 and breaking the bridges. The second manner of applying the force on the cover 26 amounts to using a reaction force E1 exerted by the surface S on which the device 20 rests to break the bridges 27.

The material used to mold the cap 24 may be a polyoxyethylene or a polypropylene, and it is chosen to cause a clean break at the small bases 271 of the bridges 27.

FIG. 13 shows that, since the small bases 271 of the bridges 27 are situated on the edge 257, the bridge 27 does not allow any irregularities to remain on that edge after the stopper 26 is removed.

According to one alternative of the invention that is not shown, the favored breaks zones of the bridges 27 may be formed not in contact with the edge 257, but at a small radial distance therefrom. In practice, the radial distance between these favored breaks zones and the edge 257 is smaller than the radial distance between these favored breaks zones and the fastening zones of the bridges 27 on the edge 261. This relationship is also verified in the case shown in the figures, since in that case, the axial distance between the small bases 271 and the edge 257 is zero, therefore smaller than the radial length of the bridges 27.

The number of bridges used in the invention is not necessarily equal to four. It is chosen based on the desired resistance to the pushing in force of the cover 26 against the elastic force E2.

Alternatively, irrespective of the number of bridges 27, said bridges may be replaced by a continuous breakable zone, in the form of a membrane.

The invention claimed is:

1. A stopping device for a container, comprising:

a stopper that mounts on a neck of a container when the stopping device is mounted on the container; and a plastic cap that covers the neck of the container and said stopper when the stopping device is mounted on the container, the cap comprising:

a ring around an orifice, the ring surrounding the neck of the container and said stopper when the stopping device is mounted on the container, the ring comprising means for locking on the neck;

a cover that covers an upper surface of said stopper when the stopping device is mounted on the container, comprising a protruding element bearing against the upper surface of said stopper; and at least one part connecting said ring and said cover, comprising bridges that extend radially between an outer radial edge of said cover and an inner radial edge of said ring, wherein an arc-shaped lumen is defined between two adjacent bridges, along the outer radial edge of said cover and the inner radial edge of said ring, the lumen having a radial width smaller than 0.3 mm and an axial height greater than 0.15 mm, and wherein a force applied to said cover in a direction parallel to a central axis of said ring and oriented toward said stopper, when the stopping device is mounted on the container, causes at least a part of said cover to sink axially into the orifice of said ring thereby breaking the at least one part, and the reactive force of said stopper on said protruding element causes said cover to eject from the container.

2. The device according to claim 1, wherein each bridge comprises a favored break zone that is closer to the attachment zone of the bridge on said ring than the attachment zone of the bridge on said cover.

3. The device according to claim 1, wherein said locking means comprise teeth each defining a locking surface perpendicular to the central axis of said ring and that bears against a collar of the container outside the neck when the stopping device is mounted on the container.

4. The device according to claim 3, wherein an annular part of said ring covers the upper surface of said stopper when the stopping device is mounted on the container, and is pierced with passage openings for pins to strip the locking surfaces from said teeth.

5. The device according to claim 4, wherein the transverse section of a passage opening of a stripping pin has an area larger than the area of the locking surface situated across from that opening, in a direction parallel to the central axis of said ring.

6. The device according to claim 3, wherein each tooth defines a surface sliding against the collar of the container, that surface being in the form of a tapered cone portion and diverging opposite said cover relative to the central axis of said ring.

7. The device according to claim 1, wherein said bridges have an axial thickness, measured parallel to the central axis of said ring, comprised between 0.1 mm and 0.3 mm.

8. The device according to claim 1, wherein said cover extends along the central axis of said ring, protruding relative to an edge of said ring opposite said locking means.

9. The device according to claim 8, wherein said cover extends, relative to the edge of said ring, over an axial height greater than or equal to two times an axial thickness of said bridges.

10. The device according to claim 1, wherein said protruding element of said cover comprises a pin that comes in contact with said stopper when the stopping device is mounted on the container.

11. The device according to claim 10, wherein when the stopping device is mounted on the container, said pin exerts a force on said stopper causing elastic deformation of a central part of said stopper.

12. The device according to claim 11, wherein, when said bridges break, said stopper exerts an elastic force on said in causing ejection of said cover, the elastic force resulting from the elastic deformation force of the central part of said stopper.

13. The device according to claim 1, wherein said ring further comprises:

a skirt that is equipped with said locking means; and an annular part, perpendicular to said skirt, that surrounds the neck of the container when the stopping device is mounted on the container, comprising at least one opening, each opening being bordered by a rib that superficially penetrates the surface of said stopper, wherein said cover is connected by said at least one part to said annular part of said ring.

14. A container that is equipped with a stopping device according to claim 1.

15. The device according to claim 7, wherein the axial thickness of said bridges is between 0.2 mm and 0.25 mm.

16. The device according to claim 9, wherein the axial height is greater than or equal to three times the axial thickness of said bridges.

17. The device according to claim 16, wherein the axial height is equal to four times the axial thickness of said bridges.

* * * * *